United States Patent [19]

Carnahan

[11] Patent Number: 4,895,066

[45] Date of Patent: Jan. 23, 1990

[54] ROOF JACK

[75] Inventor: Fay O. Carnahan, Cathedral City, Calif.

[73] Assignee: Glen C. Podell, Ridgecrest, Calif.

[21] Appl. No.: 144,116

[22] Filed: Jan. 15, 1988

[51] Int. Cl.[4] ..... F24F 7/00; F24F 13/00

[52] U.S. Cl. ..... 98/42.22; 62/259.1; 62/DIG. 16

[58] Field of Search ..... 62/DIG. 16, 259.1; 52/27, 29, 67, 72, 199; 248/122, 242, 148, 247; 285/44; 98/42.21, 42.22

[56] References Cited

U.S. PATENT DOCUMENTS

| | | | |
|---|---|---|---|
| 2,882,810 | 4/1959 | Goettl | 98/42.22 |
| 3,270,738 | 9/1966 | Nielsen | 62/259.1 |
| 3,742,659 | 7/1973 | Drew | 62/DIG. 16 |
| 4,608,834 | 9/1986 | Rummel | 62/DIG. 16 |

*Primary Examiner*—Lloyd L. King
*Attorney, Agent, or Firm*—Gerald F. Baker

[57] ABSTRACT

A roof jack is provided for mounting an air conditioner of the evaporative type on a pitched roof of a structure wherein is provided an upper frame member adapted for hinged connection with a lower frame member and said lower frame being adapted to serve as a plenum for connection to supply ducts and to contain a removable damper for preventing escape of air from the structure through the supply ducts and said upper and lower members and said upper and lower frame members being adapted for levelling by the use of prefabricated extension panels for the sides of said upper panel through which fixing screws may be inserted and fasten the sides of the upper member to the lower member.

4 Claims, 2 Drawing Sheets

ROOF JACK

SUMMARY OF THE INVENTION

This invention relates to an adjustable support means for evaporative coolers and particularly to a support for mounting coolers on the roofs of buildings.

In the past, installers of evaporative coolers on roofs of buildings have encountered problems in leveling the coolers on pitched roofs. The penetration of the roof was by a stack only slightly larger than the air effluent from the cooler fan. The stability of the cooler depended on peripheral legs or straps to the roof. The single effluent conduit usually led to a distribution plenum when more than one room was served.

Some evaporative coolers have, in the past, been mounted on roofs by supports custom built to conform to the conditions of the job at hand. The cutting, fitting and welding of various parts of the mounting often entailed many trips to and from a shop for cutting, forming and welding of parts. Moreover, it was necessary to mount the entire assembled support on the roof before the roofing material was applied. The support could, therefore, only be altered after the roof was finished with great difficulty, if at all.

A support for Evaporative Coolers is described in U.S. Pat. No. 2,882,810 Issued Apr. 21, 1959 wherein a top rectangular frame member is telescopically fitted over a lower rectangular member and the one is tilted or reversed to change the slope therebetween and then the parts are fastened fore and aft with screws.

According to the present invention, a method and apparatus has been provided which simplyfies installation of coolers on roofs of various pitches using a set of prefabricated parts which may be selected and assembled on the job with simple hand tools. It is not necessary to reverse the upper and lower members for any reason and, thus, the lower part may be prefabricated to contain a damp device in the lower portion to prevent warm air from escaping through the cooler during the colder seasons. Dampers have been installed in previous arrangements in a distribution plenum under the roof, for example, but this placement was usually inconvenient for replacement or servicing.

The upper frame of the present invention provides a large, stable and level platform for an evaporative cooler and the lower frame member provides an accessible damper compartment and serves as a plenum for distribution of air to multiple interior ducts and thus eliminates the need for any interior plenum or damper compartment.

DETAILED DESCRIPTION

Figure 1:
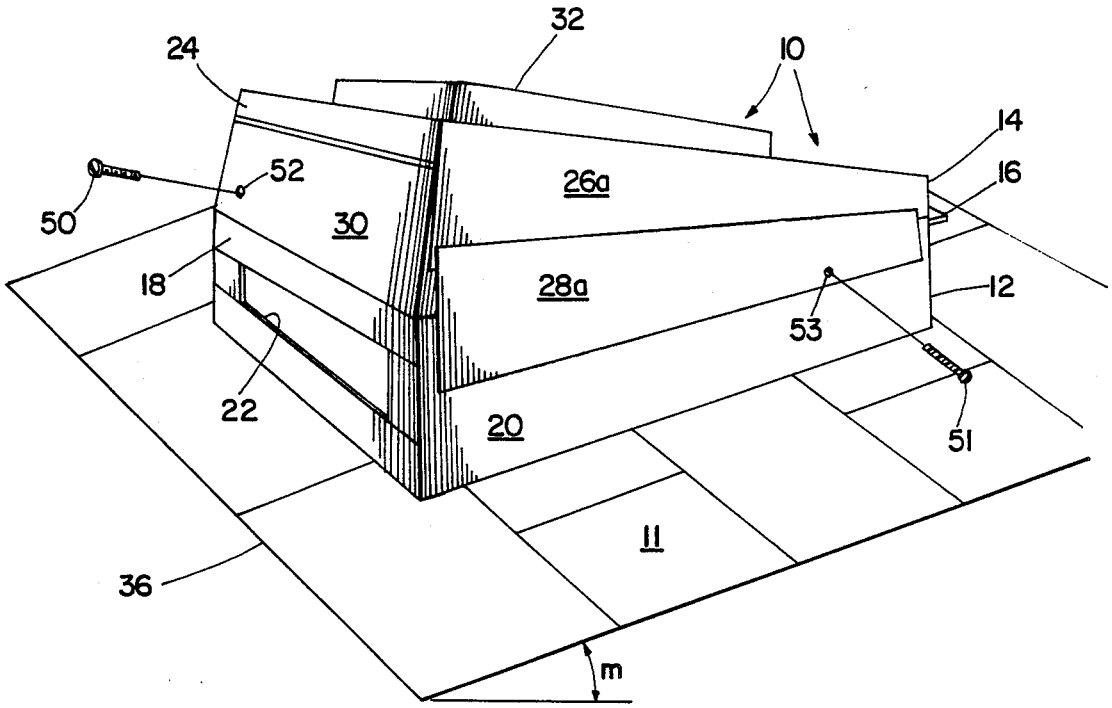
FIG. 1 is a perspective view of a roof jack according to the present invention in place on a roof with a near maximum slope with the damper partially withdrawn.

FIG. 1 illustrates a roof jack 10 according to the present invention, installed on a roof of slope m.

The roof jack 10, which allows communication through the roof 11, comprises generally a lower frame member 12, and an upper frame member 14. The two portions are connected by a loose hinge arrangement at 16 in a manner such that the upper frame member can be adjusted with respect to the lower frame member and the two members fixed together with the top surface in a level position.

The lower frame member 12 comprises a front panel 18 and side panels 20. The front panel 18 has an opening 22 to accomodate a slide-in damper (not shown) A damper device is presently commercially available which is ideal for installation in this case and which is designed to be normally closed so that ambient air does not pass through the roof except when pressure is exerted by the cooler fan (not shown) and heated air cannot pass out of the building through the cooling ducts. The upper frame member 14 comprises a front panel 24 and side panels 26*a* and 26*b*. The top 34 has an opening which is designed to be fitted with an adapter fence 32 which may be sized to fit within the opening of a conventional down draft cooler or duct work from a side draft cooler.

The front panel 24 of the upper portion is configured to avoid covering the damper in its lowermost position. In other positions an extension member 30 may be attached and cut to the desired size necessary to accomodate the adjustment for roof pitch when the size of front panel 18 is not adequate.

Figure 2:
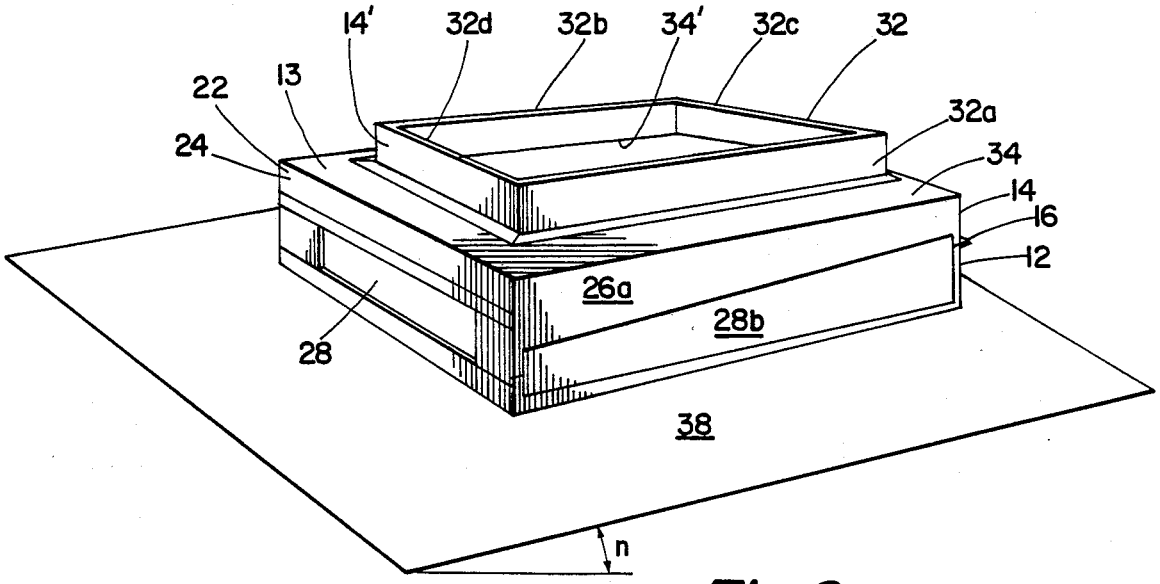
FIG. 2 is a perspective view of a roof jack prepared for an installation on a roof of minimum slope.

The side panels 26*a* and *b* of the top portion are each fitted with extension pieces 28*a* and 28*b* in a manner suitable to the pitch of the roof. On low pitch roofs the top front extension is cut off accordingly or eliminated entirely as in FIGS. 2, 4 and 5.

Figure 3:
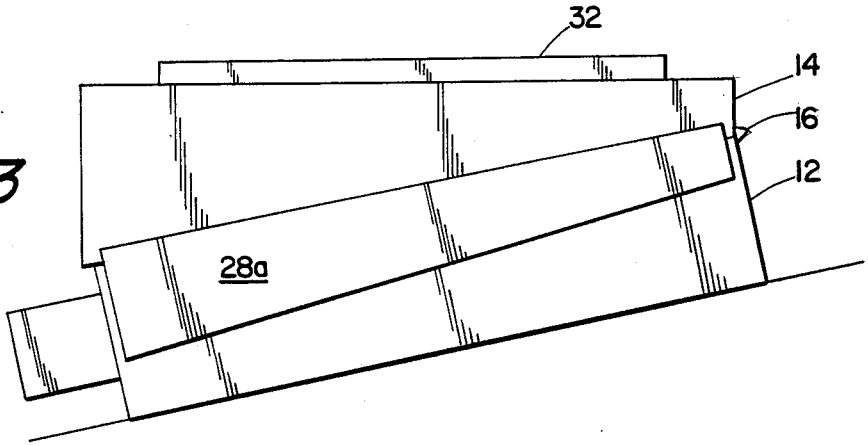
FIG. 3 is a side view of the roof jack in the same position as in FIG. 1.
Figure 4:
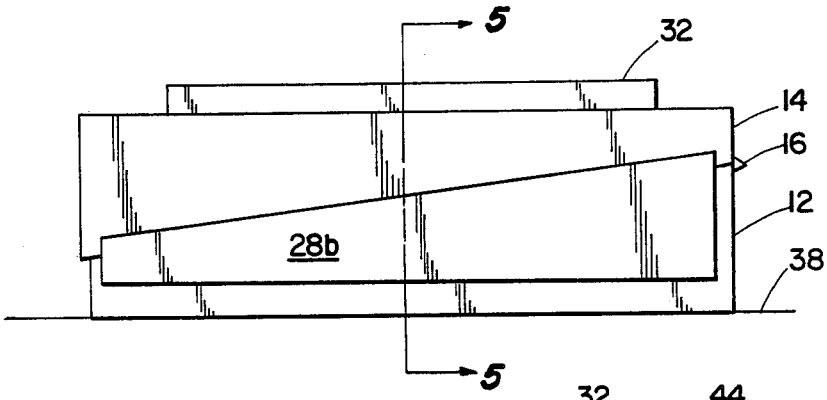
FIG. 4 is a side view of the roof jack in the same position as in FIG. 2.
Figure 5:
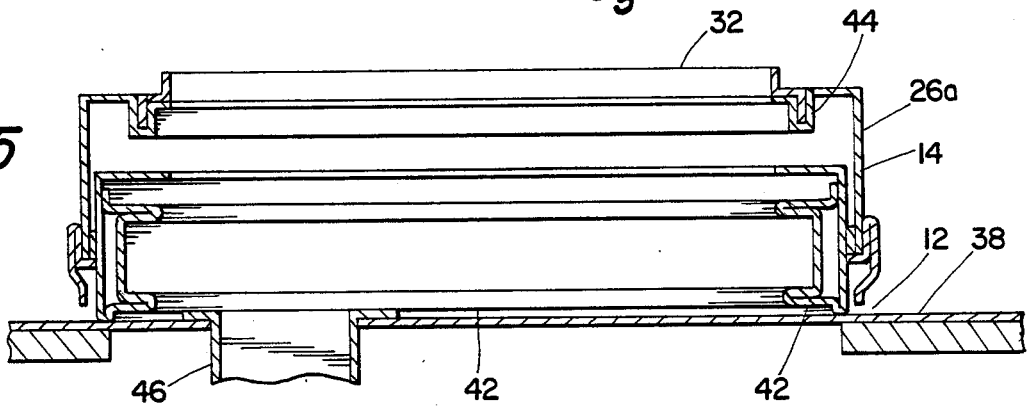
FIG. 5 is a cross sectional view of the roof jack of FIG. 4, taken along line 5—5 thereof.

The side extensions have similar but opposite attachment folds and are attached, for example, as illustrated in FIGS. 4 and 5 wherein 28*a* is attached on the near side in FIGS. 1 and 3 and on the far side in FIG. 4.

Figure 6:
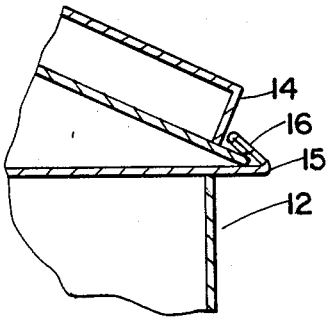
FIG. 6 is an enlarged detail view of the hinge portion, for example, in FIG. 4.

After the lower frame member is placed in position over the appropriate roof opening, the roofing material may be applied, if desired, before the installation of the roof jack is completed. To complete the installation, the upper frame is placed over the lower frame with the rear edges in line as shown in FIG. 6 and with tab 15 of the upper frame member placed in the fold 15' of the lower frame to form a sort of loose hinge joint 16 and the frame 14 is then lowered or raised to level position.

Side pieces 28*a* and 28*b* are placed as described and a front extension trimmed and placed if necessary. With the upper frame in level position and adapter pieces in place, the respective upper and lower sides and front may be fastened by sheet metal screws, for example, through the opposing pieces as shown in FIG. 1, wherein a screw 50 is shown for fitting into a hole 52 drilled through extension 30 and lower front panel 18 where they overlap and also a screw 51 similarly provided for a hole 53 to fasten panel 28*a* to lower side 20.

Figure 7:
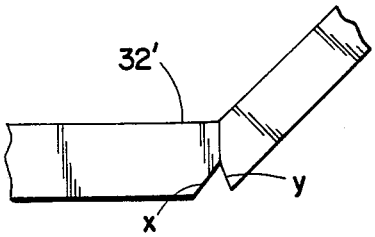
FIG. 7 is a fragmentary perspective view of a straight adapter frame for the top opening of the upper frame member.
Figure 7A:
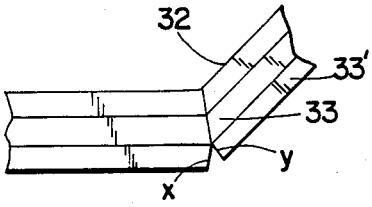
FIG. 7*a* is a similar view of an adapter with an offset to accomodate a cooler with a smaller opening.

Finally, the top opening of the upper frame member is fenced with a quadrangular sheet metal frame or fence having the lower portions thereof adapted to be placed into a groove or fold 44 fashioned around inside of the top opening of the upper member 14. See FIG. 7. For a smaller cooler, the fence 32 (FIG. *7a*) is used which has a web 33 of a desired width and a tab 33' depending therefrom with edges x and y clipped to avoid interference when being fitted into the groves at 44.

I claim:

1. A roof mounting for an air conditioner or the like for supplying air through an opening in the roof for ducting to a room or rooms therein, comprising:

a lower rectangular frame member having peripheral bottom flanges for fastening to the roof decking of a structure and a compartment with a front opening to accommodate a damper device or the like;

an upper rectangular frame member hingedly mounted on said lower member, for pivotal movement along the rear edges thereof, and having the remaining sides arranged for telescopic engagement with the sides of said lower members and said remaining sides being left, right and front panels;

said left and right panels having frictionally mounted quadrangular extension members dimensionally fabricated to be set on opposite sides and to be interchangeable between sides to accomodate low and high roof slope settings respectively of said frame members;

said front panel being dimensioned to fit over the front of said lower frame member in the lowest setting without obstructing access to said compartment therein and adapted to be frictionally fitted with a grooved quadrangular panel in a like manner as and sides and adapted to be trimmed to fit positions less than maximum.

2. Apparatus according to claim 1, wherein:

said hingedly mounted frame members include an angular appendage on the top edge of said lower member and a lip extending from the lower edge of said upper member dimensioned to fit into said angular appendage.

3. Apparatus according to claim 1, wherein said upper frame member comprises an opening in the top thereof and said opening having a channel formed in the edges thereof adapted to receive selected adaptor fences to fit within the opening in a cooler mounted on said upper frame.

4. Apparatus according to claim 1, wherein said lower frame member comprises a bottom panel adapted for the connection of a plurality of air distribution ducts.

* * * * *